United States Patent [19]

Burford et al.

[11] 3,968,748

[45] July 13, 1976

[54] TARGET DISCRIMINATING BOMBLET

[75] Inventors: Milton K. Burford, China Lake; Joseph F. Mattis, Ridgecrest, both of Calif.; Peter D. Gratton, Simpsonville; William J. Donahue, Takoma Park, both of Md.; Michael A. Halling, San Diego; Ken Pinkerton, Westminster, both of Calif.; Thomas A. Cammack, Beltsville, Md.; Rodney A. Bernardin, Wayzota, Minn.; Lee Johnson, Edina, Minn.; Art Lohmann, Hopkins, Minn.; Ed Abt, Chalfont, Pa.

[73] Assignee: The United States of America as represented by the Secretary of the Navy, Washington, D.C.

[22] Filed: Jan. 15, 1973

[21] Appl. No.: 329,263

[52] U.S. Cl. ..... 102/7.2; 102/76 R; 102/81

[51] Int. Cl.[2] ..... F42B 25/16

[58] Field of Search ..... 102/7.2, 81, 78, 79, 102/76, 74

[56] References Cited

UNITED STATES PATENTS

| | | | |
|---|---|---|---|
| 1,310,350 | 7/1919 | Kennedy | 102/73 A |
| 1,791,716 | 2/1931 | Davis et al. | 102/7.2 X |
| 2,449,540 | 9/1948 | Albin | 102/7.2 X |
| 2,801,590 | 8/1957 | Balke | 102/66 X |
| 3,505,960 | 4/1970 | Theate | 102/79 |
| 3,511,184 | 5/1970 | Bowers | 102/78 |
| 3,633,510 | 1/1972 | Bernardin | 102/7.2 |
| 3,670,656 | 6/1972 | Donahue | 102/81 |
| 3,808,972 | 5/1974 | Cammack et al. | 102/7.2 |

FOREIGN PATENTS OR APPLICATIONS

| | | | |
|---|---|---|---|
| 710,621 | 8/1941 | Germany | 102/73 A |
| 197,329 | 9/1938 | Switzerland | 105/52 |

*Primary Examiner*—Harold Tudor
*Attorney, Agent, or Firm*—R. S. Sciascia; Roy Miller; Thomas W. Hennen

[57] ABSTRACT

A target discriminating antipersonnel/antimaterial cluster weapon capable of distinguishing between hard and soft targets. Upon striking a hard target such as armor or concrete, shear rivets are defeated causing a striker to plunge a firing pin into a stab detonator which through an explosive transfer train causes immediate detonation of the bomblet. Upon hitting a soft target such as sandy soil, the shear rivets will not be sheared, however, an inertia firing weight plunges a firing pin assembly into a stab primer which leads to a propellant charge causing the bomblet to pop back up into the air. The bomblet then is detonated through a pyrotechnic delay in the air. The bomblet is armed during its descent via a flutter plate giving oscillatory motion which is transferred into rotary motion. The rotary motion is employed to align the primer and detonator with the firing pins.

2 Claims, 19 Drawing Figures

POP-UP CONFIGURATION PRIOR TO INITIATION

POP-UP CONFIGURATION DURING INITIATION

TARGET DISCRIMINATING BOMBLET

BACKGROUND OF THE INVENTION

1. Field of the Invention

This invention relates to air-to-surface antipersonnel-/antimaterial cluster weapons.

2. Description of the Prior Art

While there exists in the prior art, bomblets which discriminate between hard and soft targets, there are none which are able to discriminate between hard and soft targets and have a pop-up ability as does the present invention.

Furthermore there exists no air-to-ground weapon which arms itself by a combination nozzle and flutter mechanism as does the present invention.

SUMMARY OF THE INVENTION

The present invention is a bomblet of an air-to-surface cluster weapon capable of arming itself by air flow via a nozzle and flutter mechanism combination. Furthermore the nozzle-flutter combination will not begin the arming process unless a given minimum velocity has been reached. Additionally, the arming process is such that a given amount of time will elapse from the onset of an arming velocity to a fully armed condition.

Upon striking a target the bomblet is able to distinguish between a hard and soft target. Upon striking a hard target, shear rivets are sheared allowing immediate detonation of the warhead. Upon striking a soft target, a firing pin is inertially thrust into a stab primer setting off a propellant charge. The propellant charge propels the bomblet back into the air where it is detonated via a pyrotechnic delay extending from the stab primer.

DESCRIPTION OF THE PREFERRED EMBODIMENT

Figure 1:
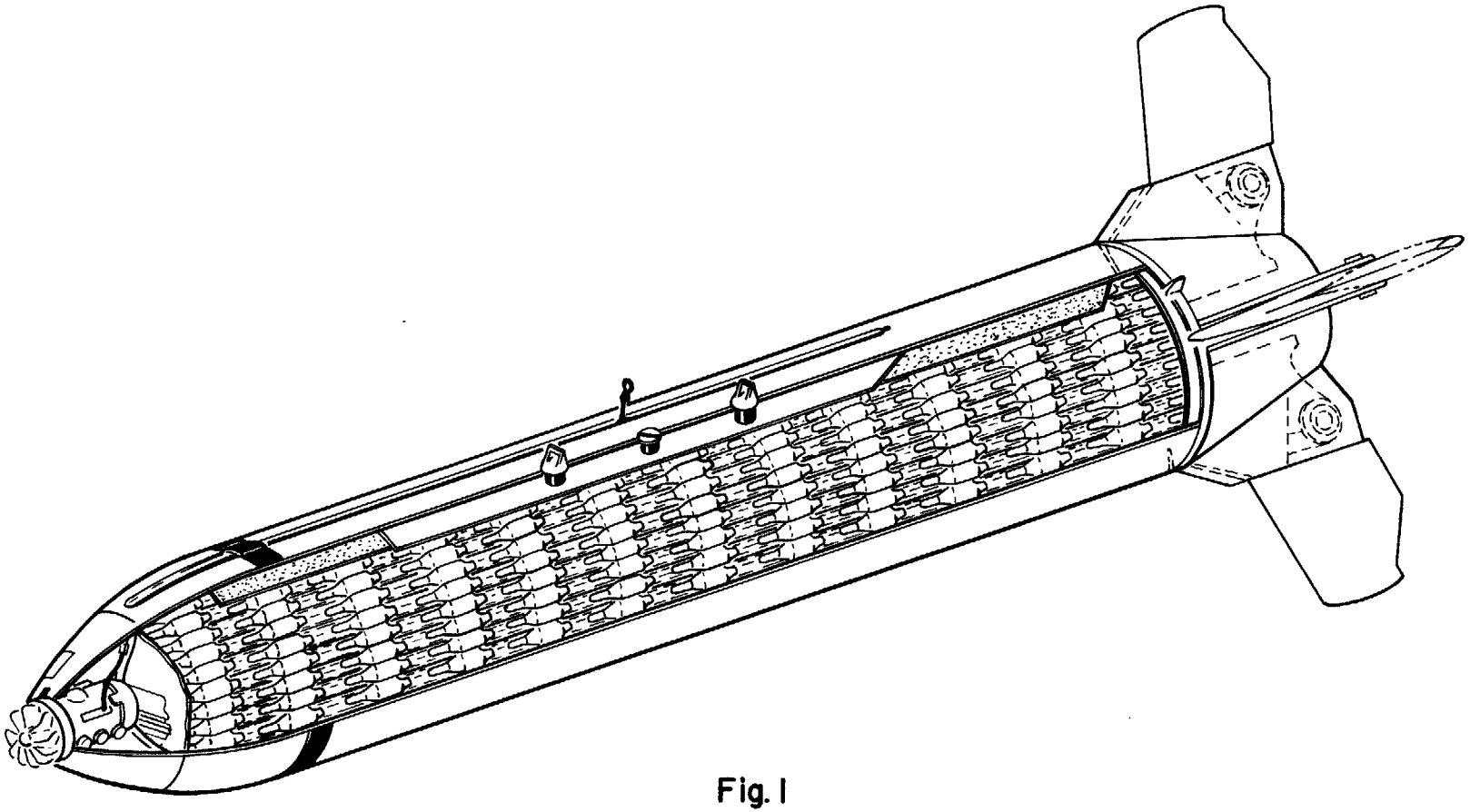
FIG. 1 is a perspective view in partial cross section of the stacking arrangement of the cluster bomb.

The antipersonnel/antimaterial (APAM) weapon is a cluster bomb of the 750-pound category and includes a dispenser as shown in FIG. 1 and a payload of 717 target discriminating, shaped charge, airburst bomblets. The bomblets are packaged in 17 wafers lengthwise of the dispenser. One wafer of 37 bomblets is placed in the nose of the dispenser followed by alternate wafers of 44 and 41 bomblets, respectively.

When the weapon is released from the bomb rack, two wires are pulled on the dispenser. The forward wire is a conventional arming wire which initiates the action of the dispenser fuze. The rear wire is the fin release lanyard. When pulled, the rear wire allows the fins at the rear of the dispenser to deploy. At some specified time after aircraft release, the dispenser fuze fires a linear shaped charge network which cuts the dispenser in half lengthwise causing the dispenser to open in clam-shell fashion. The bomblet cargo is released into the airstream and continues to fly in an expanded cone of bomblets along a trajectory approximating that of the complete weapon.

The bomblets arm at a fixed time from dispenser opening. During their period of flight, the bomblets free-fall, fin stabilized. At bomblet impact, the bomblet fuze will initiate one of the two modes of functioning. If a bomblet impacts an earth target such as mud, clay, sand, etc., the bomblet warhead will be propelled rearward (into the air) followed by an airburst of the warhead. This action will subject a wide area to high speed case fragments. If a bomblet impacts armor plate, sheet metal, or other hard surface, the warhead will fire in the super-quick mode subjecting the target to shaped charge action and the local area to high speed case fragments.

Figure 5:
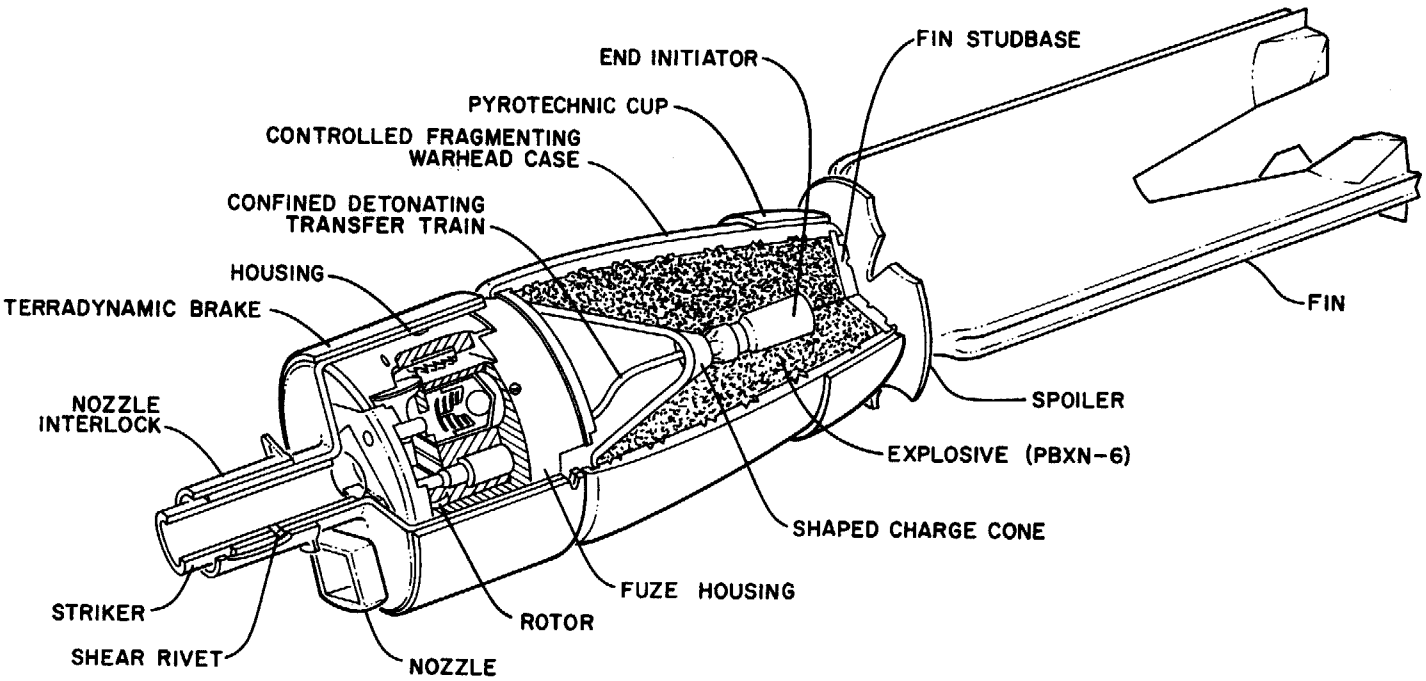
FIG. 5 is a perspective view of the bomblet in partial section.

Thus, referring to FIG. 5, the bomblet is nose fuzed and contains a controlled fragmenting warhead case with a conical shaped charge. A pyrotechnic cup of zirconium metal is fitted to the outside of the warhead case at its base. The fuze is surrounded by a mortar-like housing and striker assembly. A nozzle interlock sleeve is placed over the striker housing to insure retraction of the fuze nozzle when the bomblet is packaged into the dispenser. The bomblet fin is made as one piece of unbreakable plastic. An aerodynamic spoiler plate is fitted between the warhead case and fin.

The external configuration of the bomblet is designed to produce maximum aerodynamic drag. This factor contributes to bomblet shaped charge performance against armor and lessens the structural requirements imposed on the fuze during soft target impact and subsequent bomblet pop-up. The bomblet terminal velocity is 245 feet per second indicated air speed. The principal drag producing feature on the bomblet is a result of the sharp corner on the leading edge of the major body diameter. This edge is formed by the terradynamic brake which surrounds the housing. A more detailed description of the terradynamic brake may be found in U.S. Pat. Application Ser. No. 203,564 filed Dec. 1, 1971. Aerodynamic drag forces on the bomblet are further increased through the use of the spoiler plate at the base of the warhead and the integrally molded hollow wedges on the tips of the plastic fin.

The terradynamic brake aids the bomblets' deceleration in soft soils thereby lessening the depth of hole in soft soils from which the bomblet must be propelled. Brake function occurs on soils softer than about 150 psi cone penetrometer reading (standard point). Impact with soft soils causes the brake to peel back, exposing a larger frontal area on the leading edge of the housing.

BOMBER FUZE

The APAM bomblet fuze uses a new technique for powering the fuze rotor into line and sensing safe arming thresholds (air speed discrimination). A flutter oscillator is used to perform these functions.

Figure 6A:
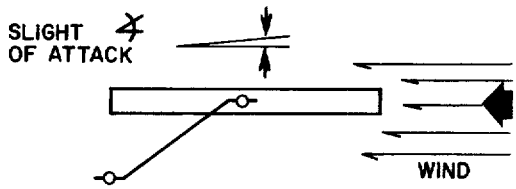
FIGS. 6*a*, *b*, *c*, and *d*, *e*, *f*, and *g* show the flutter mechanism in elevation and demonstrate in sequence the operation principles.
Figure 6B:
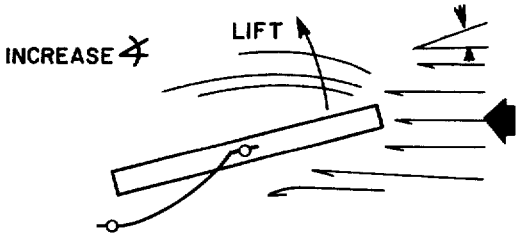
Figure 6C:
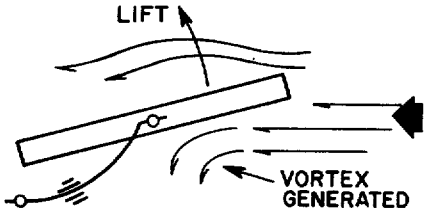
Figure 6D:
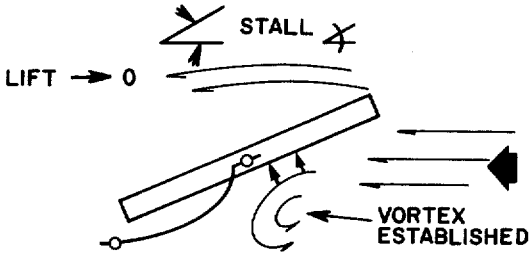
Figure 6E:
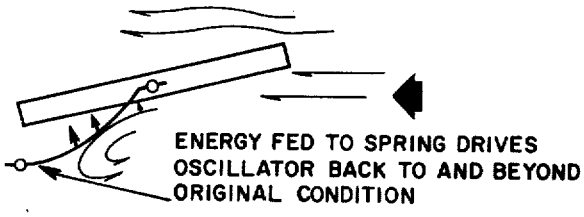
Figure 6F:
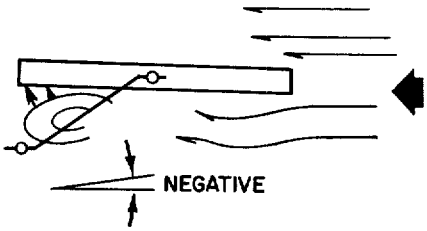
Figure 6G:
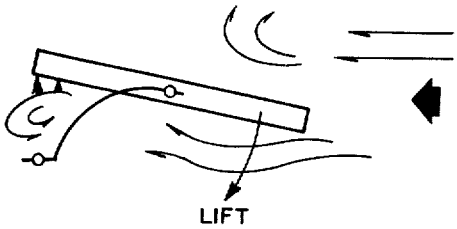

The fundamental operational principals of the APAM flutter oscillator are shown in FIGS. 6*a*, *b*, *c*, *d*, *e*, *f* and *g*. A rectangular flat plate (flutter) with a shaft through the mid-cord is supported between two journal bearings. One end of a leaf spring is staked to one end of the shaft and the other end of the spring is held in place between two hard points in the fuze housing. Ram air is directed over the leading edge of the flutter at a zero angle-of-attack. Aerodynamic turbulence causes the flutter to rotate. After a slight angle-of-attack has been reached the flutter acts like a wing with respect to the airstream. Under these conditions a lift force will be produced on the front upper (or lower) surface of the flutter, causing the flutter assembly to rotate. During its period of rotation a vortex is established under the leading edge of the flutter. Additionally, the spring is being flexed. When the flutter angle-of-attack approaches about 20° an aerodynamic stall condition is reached which causes the lift force to greatly diminish. The energy fed into the spring is now great enough to cause rotation in the opposite direction. During this period of reverse rotation the vortex has progressed to the rear of the flutter, providing further restoring power. The effect of the return spring and the vortex is to drive the flutter into a negative angle-of-attack whereupon the process is repeated.

Figure 7A:
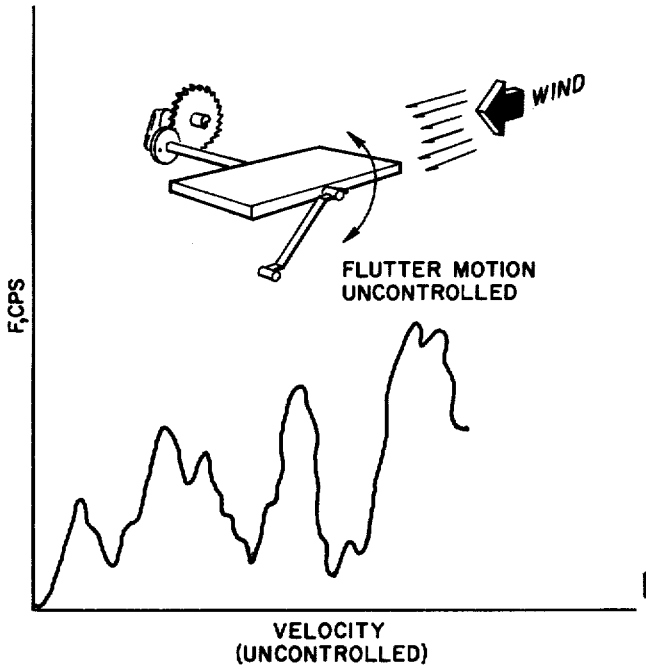
FIG. 7*a* shows a graph of the flutter mechanism in an uncontrolled mode.
Figure 7B:
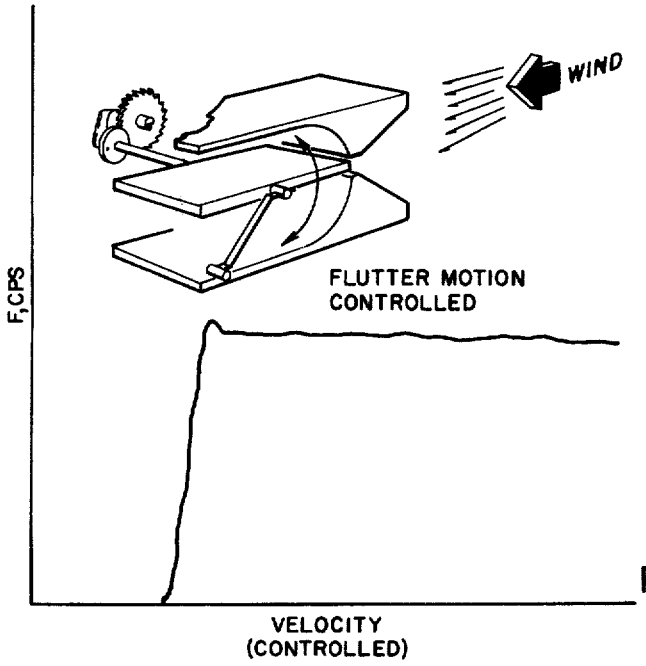
FIG. 7*b* shows a graph of the flutter mechanism in a mode controlled by the nozzle.

FIGS. 7*a* and 7*b* depict flutter frequency as a function of air speed for an uncontrolled and controlled flutter. Flutter frequency in both cases is taken as positive indexing of a ratchet wheel driven by a pawl finger attached to the oscillator shaft. In the uncontrolled case, flutter frequency is not uniform as a function of air speed. When the flutter is mounted inside of a rectangular converging/diverging nozzle, flutter oscillation does not occur until a threshold velocity is reached. The system may be tuned in the case of APAM to be the minimum safe arming velocity. When this velocity is reached, oscillation frequency remains fairly constant and is predictable. This in effect allows the flutter to be used as a clock motor.

Figure 8:
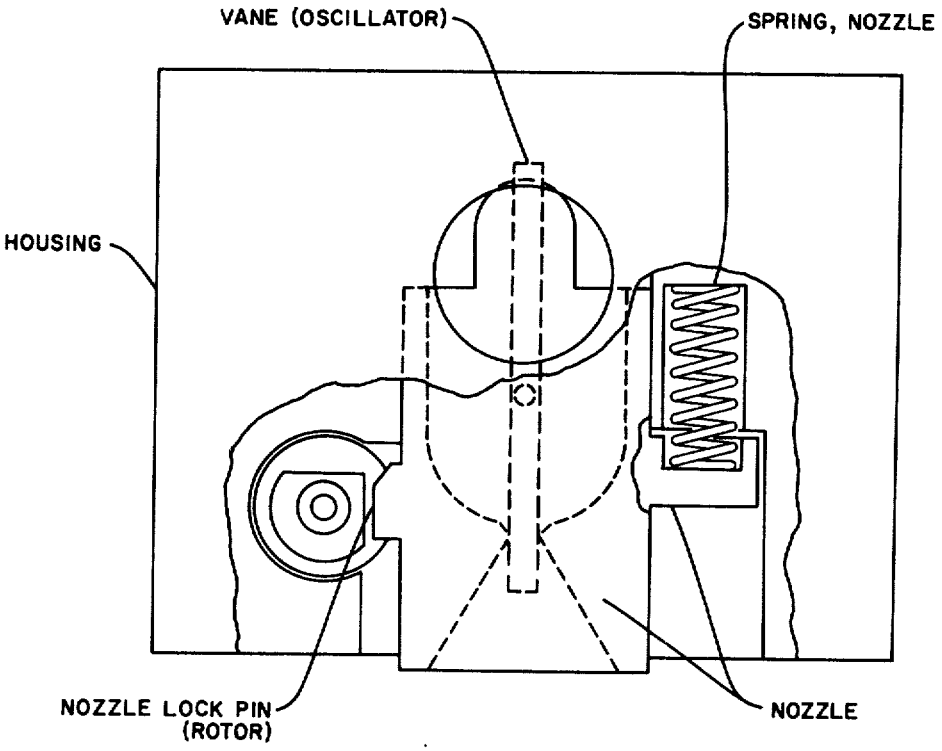
FIG. 8 is an elevation view showing the nozzle in its recessed, safe position.
Figure 9:
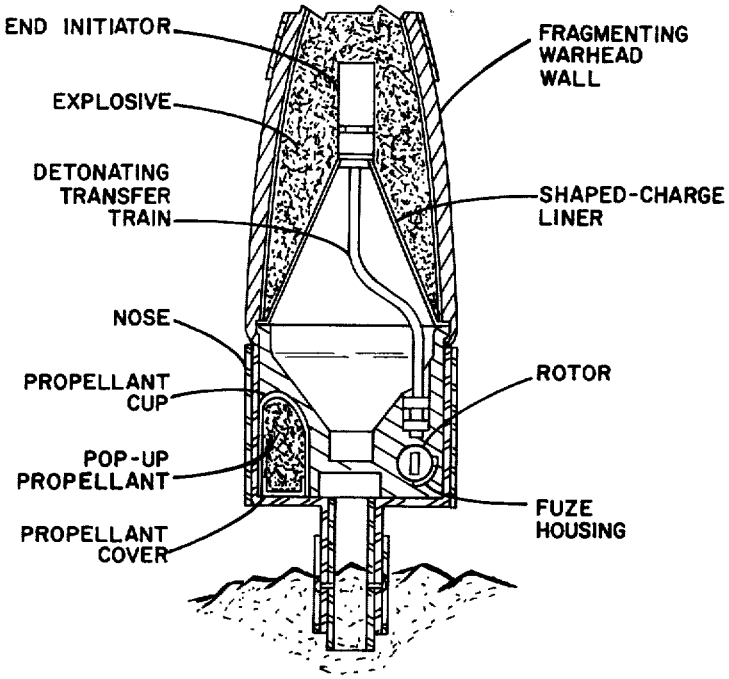
FIG. 9 is an elevation-section view of the bomblet.
Figure 10:
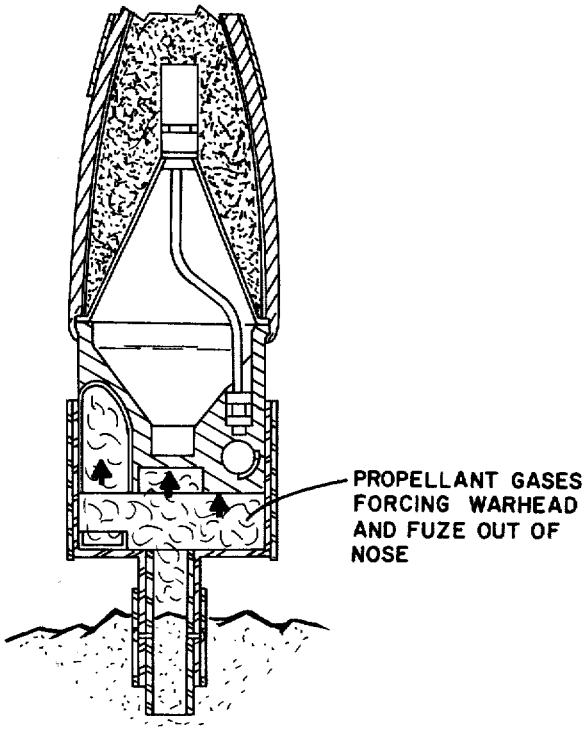
FIG. 10 is an elevation-section view of the bomblet.

When the bomblet is packaged in the dispenser, the spring loaded fuze nozzle is depressed into the fuze housing and is held there by the base of a preceeding bomblet or packing spacer. FIG. 8 depicts this nozzle-flutter vane arrangement. This action insures that the fuze is fully locked. The throat of the nozzle traps the flutter preventing oscillation regardless of weapon vibration or other cyclic load. Further, an integral die cast boss on the side of the nozzle cam interfaces with a flat on the end of the rotor. This insures against rotor rotation toward the armed condition under any circumstance. When the bomblet is deployed into the air the nozzle extends, unlocking the flutter and rotor.

Figure 11:
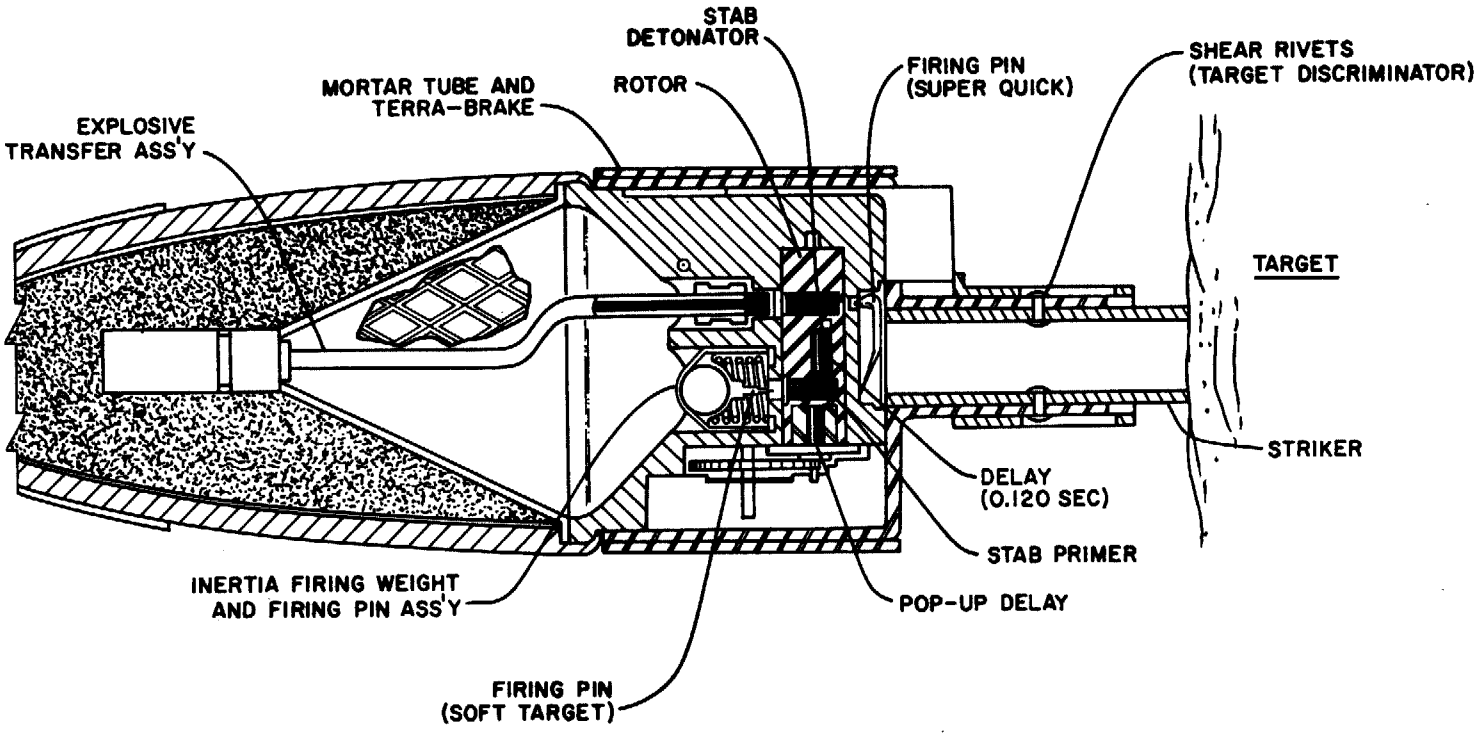
FIG. 11 is an elevation-section view of the bomblet.

Referring to FIG. 11 it can be seen that upon impact with a hard target the striker which is pinned to the nose shears two shear rivets, allowing the striker to plunger into the fuze. As the striker moves rearwardly into the fuze it encounters a lever plate with an integral firing pin. The striker depresses the firing pin into the stab detonator. Initiation of the stab detonator ultimately results in an initiation of an acceptor explosive charge fastened to a mild detonation transfer line. The detonation signal is then conducted through the transfer line back to a booster charge which is fastened to the line. Initiation of the booster results in a detonation of the explosive charge causing the warhead case to fragment and the conical shaped charge to jet into the target. The sequence of events in the super-quick mode from impact to warhead detonation occurs within 65 microseconds.

Figure 2A:
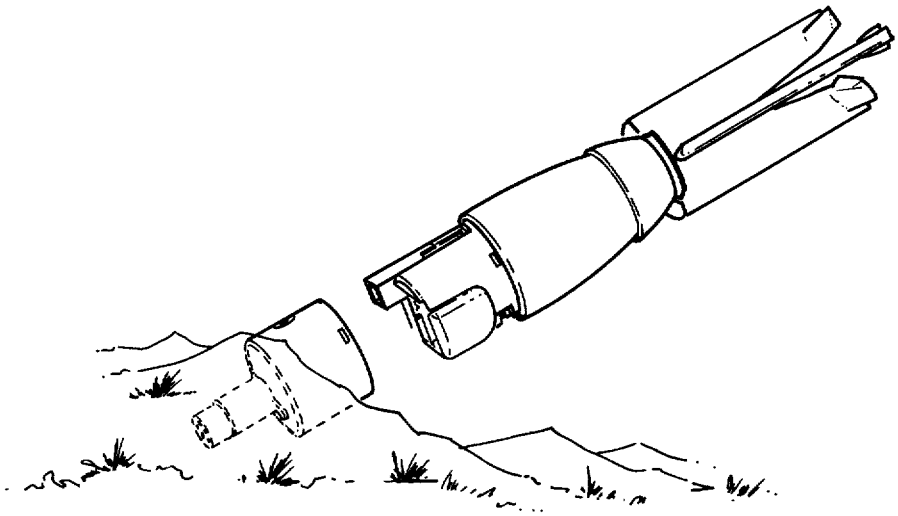
FIG. 2*a* shows the bomblet in the soft target mode.
Figure 2B:
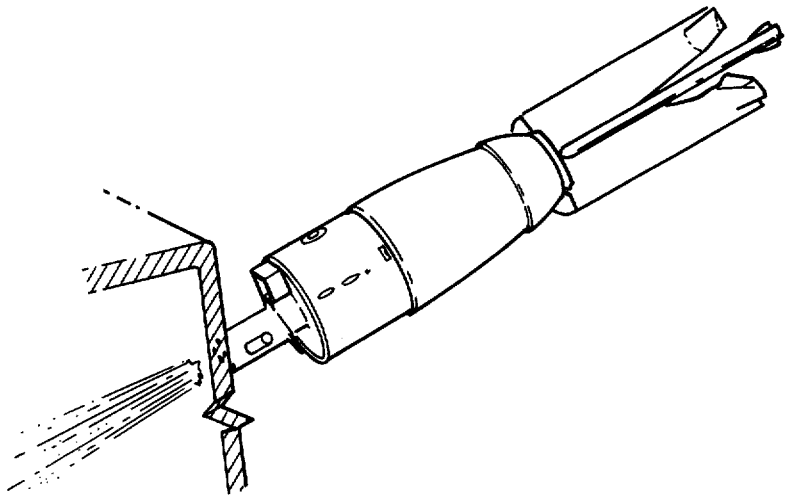
FIG. 2*b* shows the bomblet in the hard target mode.
Figure 3:
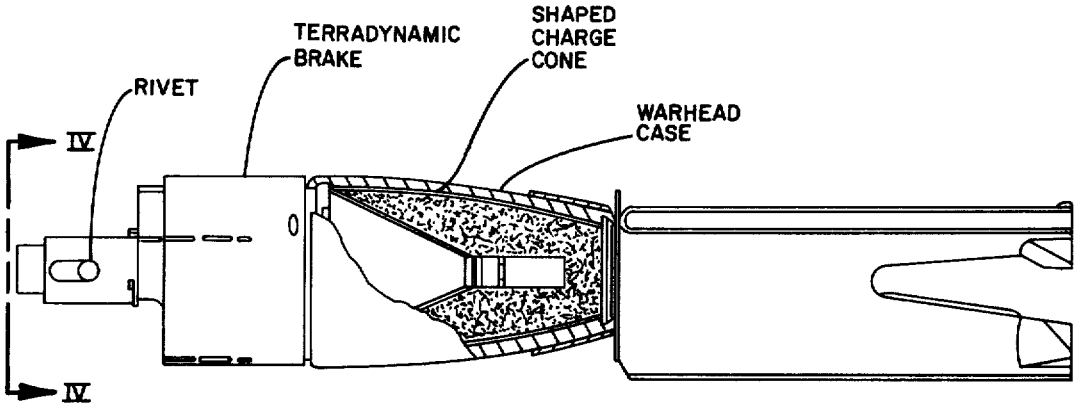
FIG. 3 is an elevation view in partial cross section of the bomblet.
Figure 4:
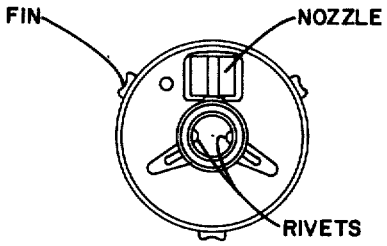
FIG. 4 is an elevation view of the forward end of the bomblet taken in the direction of arrows IV — IV of FIG. 3.

Upon impact with a soft target, the forces of impact acting on the striker are not great enough to cause the rivets to shear. In this event the soft target firing mechanism, positioned above a stab primer in the rotor, plunges a stab pin into the primer. It will be noted that the soft target firing mechanism is of the hemi omnidirectional type. The output of the primer simultaneously side ignites two pyrotechnic time delays. The pop-up delay burns for 30 milliseconds and then ignites an output charge. The burning products of the output charge flash through a conduit in the fuze housing and ignite a heavily canned black powder expulsion charge. The expulsion charge propels the fuze, warhead and fin assembly back into the air as shown in FIGS. 2*a* and 2*b*. The long pyrotechnic time delay ultimately ignites an output charge while the bomblet is in the air. This delay output initiates the stab detonator by flash and shock. The balance of the detonation sequence then continues in the same manner as described for the hard target sequence.

BOMBLET WARHEAD

The APAM bomblet warhead consists of a fragmentation warhead case, conical shaped charge liner, end cap assembly, aerodynamic spoiler, pyrophoric cup, and a main explosive load. The APAM warhead case has been designed to produce 5.5 grain (nominal weight) steel fragments. The selection of this fragment size is consistent with performance requirements for personnel and light material. Fragment velocities range from 3384 to 5250 feet per second depending on the charge to metal ratio at any given zone along the case.

The APAM conical shaped charge liner is a 50°, 3 percent, 1.37-inch diameter, non-precision copper cone with an integral spit-back tube. The spit-back tube is used to fasten the transfer line booster assembly to the cone.

What is claimed is:

1. A target discriminating bomblet for distinguishing between hard and soft targets, comprising:

a warhead, having an ogive-shaped fragmentation case; a conical shaped charge liner mounted within said case; an explosive load located in said case between said case and said liner; and a zirconium cup circumferentially attached to said case; and a fuse, having a stab detonator;

an explosive transfer line, one end of which is adjacent to said detonator and the other end of which is attached to a booster charge located within said warhead;

a first firing pin located adjacent to said detonator when the bomblet is armed;

a first cylindrical body held closely within a second cylindrical body forming a part of a housing for said fuze and relative axial movement between said two cylindrical bodies being prevented by at least one shear rivet passing through walls of said bodies;

a stab primer;

a second firing pin having a pointed and a non-pointed end, said pin located adjacent to said primer when the bomblet is armed;

expulsion means for propelling the bomblet warhead into the air after the bomblet has impacted a soft target;

a first pyrotechnic delay connecting said primer with said expulsion means for igniting said expulsion means;

a second pyrotechnic delay connecting said primer with said detonator;

said second delay being sufficiently longer than said first delay so that the bomblet warhead is propelled into the air prior to detonation of said warhead;

said housing defining a ball mass chamber having a centering receptacle which forms a first end of said chamber opposite said stab primer, and said primer forming a second end of said chamber;

a metal ball-shaped inertial mass poised to inertially plunge said second firing pin into said primer upon a sudden deceleration of the bomblet, said ball mass being contained within said chamber;

a hemispherical cup attached to said non-pointed end of said second firing pin and holding said ball-shaped mass within said cup; and resilient means for urging said cup and said second firing pin away from said primer and toward said centering receptacle;

so arranged and constructed that the bomblet striking a soft target will fail to activate said first firing pin and will activate said second firing pin to initiate said expulsion means for propelling the bomblet warhead into the air where said warhead is detonated, and so that the bomblet exhibits pyrophoric properties upon detonation.

2. The bomblet of claim 1 wherein said expulsion means is a canned black power expulsion charge.

* * * * *